US008124003B2

(12) United States Patent
MacArthur et al.

(10) Patent No.: US 8,124,003 B2
(45) Date of Patent: Feb. 28, 2012

(54) METHOD AND APPARATUS FOR REMOTE CONTROLLING MONITORING AND/OR SERVICING HEAT-TREATMENT EQUIPMENT VIA WIRELESS COMMUNICATIONS

(75) Inventors: David Norman MacArthur, Kincardine (CA); Colin Green, Letchworth Garden (GB)

(73) Assignee: Superheat FGH Technologies Inc., Kincardine, Ontario (CA)

( * ) Notice: Subject to any disclaimer, the term of this patent is extended or adjusted under 35 U.S.C. 154(b) by 656 days.

(21) Appl. No.: 11/770,842

(22) Filed: Jun. 29, 2007

(65) Prior Publication Data

US 2008/0001334 A1 Jan. 3, 2008

Related U.S. Application Data

(60) Provisional application No. 60/806,183, filed on Jun. 29, 2006.

(51) Int. Cl.
*C21D 11/00* (2006.01)

(52) U.S. Cl. ..... 266/99; 266/78

(58) Field of Classification Search ..... 266/78, 266/99, 100; 148/508
See application file for complete search history.

(56) References Cited

U.S. PATENT DOCUMENTS 5,185,513 A * 2/1993 Pacileo ..... 219/497
7,431,780 B2 * 10/2008 Myhr et al. ..... 148/508
2002/0156542 A1 * 10/2002 Nandi ..... 700/30

OTHER PUBLICATIONS

Sandeep Banga, "Real-time control and optimization for heat treaters" May 2002, Industrial Heating.*
Norm MacArthur, "Wireless technology garuntees sucessful heat treating" Apr. 2006, Industrial Heating.*
Stephanie Vaughn, "Hitting pay dirt—in pipe" May 2006, the fabricator.com.*

* cited by examiner

*Primary Examiner* — Scott Kastler

(57) ABSTRACT

A method and apparatus provide for remote control, monitoring and/or servicing of heat-treatment equipment via wireless communications networks. Specifically, the method and apparatus can be used in pre and post-weld heat-treatment applications for steel pipes in a variety of industries, including, but not limited to, power plants, chemical and petrochemical plants and refineries. Importantly, the embodiment generates and manages all the documentation necessary to input and verify the specified heat-treatment process. It will produce and deliver to the customer the reports and certificates required by the applicable quality control standards, requirements and regulatory authorities.

6 Claims, 9 Drawing Sheets

SCHEDULE A

PRE-WORK ORDER FORM

PWO NUMBER CHROME - P91-1

Regional Office: SuperheatFGH Local Office

Phone No.: 877-396-1324

Customer: Company Name

P.O.#: 129843

Project Start Date: Month/Day/Year

Address: 123 Customer St

Sales order#: S 12349

Project Start Time: 7:00 AM

Your City, State

Job Location: Company Job Site

Tech Assigned: Superheat Technician

Client Rep: QA Rep

Client Phone#: (555) 555-7890

Cell Phone#: (555) 555-1234

Client Rep: Heat Treatment for the various jobs to be done through put your plant NOTE: This covers all the jobs that contain P91 material under 1" thick.

Reference your welding procedure #WP-12-345

☒ Piping ☒ Boiler ☒ Vessel ☐ Refractory

| QTY | MATERIAL | SIZE | COMMENTS/DESCRIPTION |
|---|---|---|---|
| Amount | P-91 | Various | Local Electric Preheat/PWHT on various welds |
| | | | |
| | | | |
| | | | |

SPECIAL INSTRUCTIONS: This PWO covers less than 1" Thickness only. Over 1" thick material will require another Pre-Work Order #

NOTE: Preheat Inter-pass Temperature must not exceed 600 degrees F

FIG-2A

TO FIG-2B

FROM FIG-2A

PROPOSED HEAT CYCLES

PRE-HEAT:

Hold at: 450 °F, +/- 150

PWHT/BAKE OUT:

Ambient to: 600 °F at moderate rate

Above 600 °F Increase Temp To 1400 °F @ 400 °F /hr Max

Hold for 2.0 Hrs. at 1400 °F, +/- 25 °F,

Cool to 600 °F at 200 °F /hr Max, Cool to _____ °F at _____ °F /hr Max

Cool to ambient under insulation? YES [4] NO [ ]

ANCILLARY SERVICES SUPPLIED BY CLIENTS AS APPLICABLE

- [4] Pipe or vessel adequately supported for heating and free of fluids or gasses
- [4] Scaffolding erected in advance and tagged
- [4] Abatement of hazardous materials by client
- [4] Safe Work permit in hazardous area
- [4] Emergency first aid service available
- [4] Welds identified (flagged or painted)

OTHER: Any other work place areas that may have hazardous conditions

Customer acknowledges that it has reviewed and inspected this pre-work order and approves of all heat cycles, work procedures and/or services covered by the same
All work is subject to approval in writing on the space provided by the client prior to the commencement of work.

| Superheat Technician | | mo/dy/yr |
|---|---|---|
| Superheat FGH Technician | Customer Signature | Date |

FIG-2B

SCHEDULE C

SCHEDULE D

BRINELL HARDNESS REPORT

Customer: Company Name Sales Order#: S12349 Date: mo/dy/yr

Site Location: Company Job Site

| Chart/File No. Line No. | | Location | Weld No. | Bar Hardness | CapHaz | | | Parent Metal |
|---|---|---|---|---|---|---|---|---|
| sc3104050405 | 12345-76902 | | FW-16 | 207 | 204 | 201 | 202 | 200 |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |

Customer acknowledges that it has reviewed and inspected this document, and has accepted the readings covered by same.

Superheat Technician

Superheat Technician Signature | Customer Signature | Date

FIG-5

SCHEDULE E

SUPERHEAT FGH CONTROL UNIT CERTIFICATE OF CALIBRATION

Instrument Description: Supercontroller Unit (Super Pac)

Range: 0–2000°F  Serial Number: SC3104

Sensor Type: K  Calibration Procedure Number: QEP–SC–CCAL(Rev.0)

Date: April 1, 2006  Calibration Date: September 29, 2006

This instrument has been calibrated within the manufacturer's specifications. These specifications state that the maximum allowable error is +/–6°F

| Input Signal | 200 | 600 | 1000 | 1400 | 1800 |
|---|---|---|---|---|---|
| °F As Found | 200 | 601 | 1000 | 1400 | 1800 |
| °F As Left | 200 | 601 | 1000 | 1400 | 1800 |

MEASURING & TEST EQUIPMENT USED

Make: FGH  Type: Ez–Cal  Model: MK–3

| Serial No. | Cert. Date | Cal Due Date |
|---|---|---|
| 3030 | January 10,2006 | June 9, 2006 |

Environmental Conditions: Temperature: 72°F  Relative Humidity(%) 32

The above unit has been calibrated & tested. It is directly traceable to the National Institute of Standards & Technology (N.I.S.T.) and to the National Regulatory Commission (N.R.C.)

Kincardine, Ont.
Regional Office

Nigel Ford
Calibrated By (519) 396–1324
Telephone

Signature

FIG–6

SCHEDULE F

DAILY EQUIPMENT AND MATERIAL WORK ACCEPTANCE FORM

Regional Office: Superheat FGH Local Office  Phone Number: 877-396-1324

Customer: Company Name  P.O. # 129843  Date: Month/Day/Year

Address: 123 Customer St.  Job Location: Company Job Site  Sales Order#: S12349

Customer Rep.: QA Rep  Customer WO#: 5431563-9530  Phone: (555)555-7890

Work Description: Heat Treatment for the various jobs to be done through out your plant NOTE: This covers all the jobs that contain P91 material under 1" thick, reference your welding procedure #WP-12-345

| EQUIPMENT DESCRIPTION | SITE LOCATION | REG HRS | PREM HRS | DT HRS |
|---|---|---|---|---|
| Super 6Wi – SC3104 | Company Job Site | 8 | 2 | |
| | | | | |
| | | | | |
| | | | | |
| | | | | |
| | | | | |
| | | | | |
| | | | | |
| | | | | |
| | | | | |
| | | | | |
| | | | | |
| | | | | |

FIG–7A

TO FIG–7B

FROM FIG–7A

| | | | | |
|---|---|---|---|---|
| | | | | |
| | | | | |
| | | | | |
| Site Vehicles (Unit No.) | | | | |
| Mileage: | | | | |

Other:

Comments: All Inclusive Equipment Rate plus diameter inch rate only. Hardness rate/impression. No other charges.

| QTY | CONSUMABLE MATERIALS | QTY | CONSUMABLE MATERIALS | QTY | INSULATION |
|---|---|---|---|---|---|
| 4 | Hardness Test (BHN/Micro) | | Thermocouple Wire (/ft) | | Non Ceramic (.sq. ft) |
| 48 | Diameter Inches | | Pins and Clips (each) | | Ceramics (/sq. ft) |
| | Iron Wire (1 roll) | | Banding (/ft) | | Non Ceramic (/box) |
| | | | | | Ceramics (/box) |

Customer acknowledges that they have reviewed and inspected this work acceptance form and all products, work and/or service covered by same. Customer acknowledges receipt or a copy of this work acceptance form and accepts all said products, work and/or service as being satisfactorily received and completed in accordance with customer's plans, specifications and instructions.

Superheat Technician
Superheat Representative (please print)

Customer Signature

FIG–7B

METHOD AND APPARATUS FOR REMOTE CONTROLLING MONITORING AND/OR SERVICING HEAT-TREATMENT EQUIPMENT VIA WIRELESS COMMUNICATIONS

CROSS-REFERENCE TO RELATED APPLICATIONS

This application is a non-provisional of U.S. Ser. No. 60/806,183, filed 29 Jun. 2006. This application claims the benefit of priority from that application, which is incorporated by reference as if fully recited herein.

TECHNICAL FIELD

The disclosed embodiments relate to a method and apparatus to remotely control, monitor and/or service heat-treatment equipment via wireless communications networks. Specifically, the method and apparatus can be used in pre and post-weld heat-treatment applications for steel pipes in a variety of industries, including, but not limited to, power plants, chemical and petrochemical plants and refineries. Importantly, the embodiments generate and manage all the documentation necessary to input and verify the specified heat-treatment process. They produce and deliver to the customer the reports and certificates required by the applicable quality control standards, requirements and regulatory authorities.

BACKGROUND OF THE ART

Alloy steel pipes used in power plants, chemical and petrochemical plants and refineries require stringent and verifiable temperature control during pre- and post-welding. In the case, for example, of Cr—Mo—V P91, the area to be welded (hereafter the weld area) must be pre-heated to a specific temperature before welding is performed. As is well known, an untreated weld is subject to the risk of hydrogen cracking due to residual stresses. In order to eliminate this risk, post-weld heat-treatment methods are applied to the weld area. Post-weld heat-treatment is the process of heating a metal component to a sufficient temperature below its transformation temperature, holding the metal component at that temperature for a predetermined amount of time, followed by uniform cooling. Typical stress relief temperatures for steel pipes range from 600° F. to 1650° F.

Traditional heat-treatment methods for pipe welds utilize standard power supplies hard-wired to heating cables, which are wrapped around the weld area. Thermocouples are also attached to the weld area. A thermocouple is a device that measures temperature by converting heat energy into electrical energy. The thermocouple is spot-welded at one end to the weld area. At the other end the thermocouple wires, called leads, are connected to an on-off controller located in a heat-treatment unit. This provides the on-off control to the heater cables in order to achieve the desired temperatures-time cycle.

A conventional heat-treatment unit contains a local controller that can be programmed to provide the appropriate temperature to the weld area through the heating cables. It also contains a strip chart temperature recorder, which records and displays the data locally. A plurality of on-site technicians is required to carry out the various tasks involved in the process, such as installing the heater cables and monitoring the temperature charts of long heat-treatment cycles.

The conventional method of heat-treatment is expensive, inflexible and only provides real-time status and operational temperature checking to technicians at the site of the heat-treatment unit. It is preferable to provide constant and real-time temperature monitoring, as well as a reduction in the number of on-site technicians.

SUMMARY OF THE INVENTION

Accordingly, it is an object to provide the capability to remotely control, monitor and/or service the heat-treatment equipment and process via a wireless communications network, from a central location.

In one embodiment, a specially configured heat-treatment unit, called a Super 6Wi, is used as hereafter described. The Super 6Wi is a unique heat-treatment unit that collects, records and processes temperature data from the thermocouples attached to the weld area. This data is stored locally, as well as transmitted remotely through an in-plant secure wireless network to the Site Access Manager (SAM). The SAM collects and stores temperature data from up to 100 Super 6Wis. The SAM then encodes and transmits this data either wirelessly or through a wired Internet connection to a central location, called the Quality Management Center (QMC).

The QMC is at the heart of the remotely controlled heat-treatment process. The QMC performs a number of functions with reference to the heat-treatment process. First, it collects, analyzes and stores the received temperature data. Second, it performs temperature cycle monitoring and equipment control. Third, it produces complete and accurate records of the heat-treatment process, thereby ensuring compliance with quality control standards and requirements. The user may view the collected temperature data in real-time by using the included proprietary Super View software, through any popular wireless device, such as PDA, laptop or cell phone.

Wireless communication between the heat-treatment unit and the SAM provides a number of advantages. These include the elimination of cable/wire installation, elimination of possible disruptions in case of cable/wire damage, and access to real-time temperature data from any computer, Tablet PC, PDA or digital cell phone. In addition, the connection between the Super 6Wi's, through the SAM, to a central location, offers a reduction in the number of on-site technicians required for monitoring the heat-treatment process.

Further features will be described or will become apparent in the course of the following detailed description.

BRIEF DESCRIPTION OF THE DRAWINGS

In order that the scope of the discovery may be more clearly understood, embodiments thereof will now be described in detail by way of example, with reference to the accompanying drawings, in which:

FIG. 2 is an exemplary Prework Order Form outlining the specific requirements of the heat-treatment process;

FIG. 5 is an exemplary Brinell Hardness Report containing the results of the hardness test;

FIG. 6 is an exemplary Certificate of Calibration evidencing the calibration of the Super 6Wi; and FIG. 7 is an exemplary Daily Equipment and Material Work Acceptance Form, evidencing the customer's acceptance of the heat-treatment performed.

DESCRIPTION OF PREFERRED EMBODIMENTS

In the embodiments disclosed here, the heat-treatment process is remotely monitored and controlled from the QMC, by using the Internet to connect to the SAM and via a local, in-plant, secure wireless network which connects the SAM to the Super 6Wi.

Figure 1:
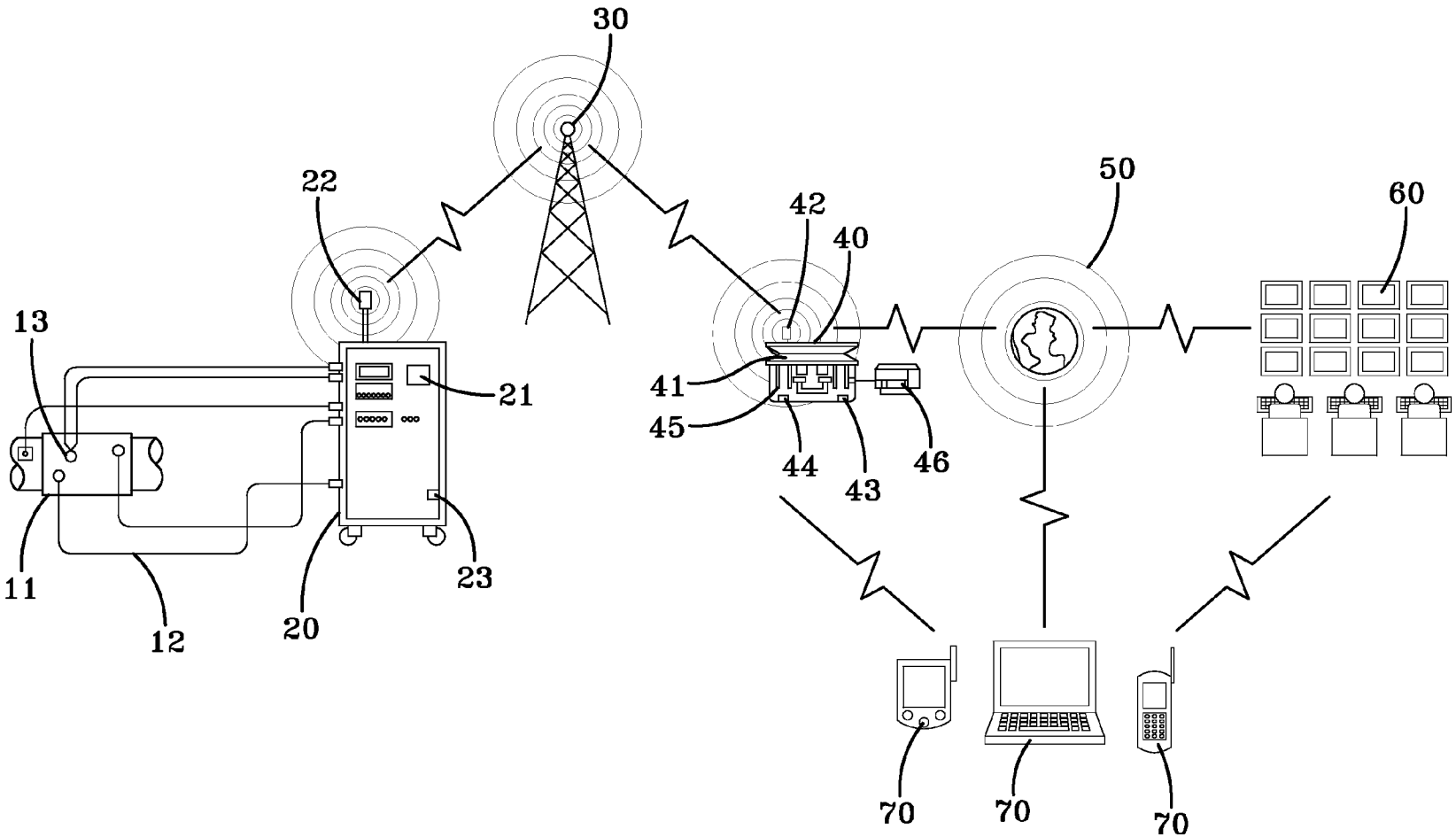
FIG. 1 is a block diagram of a system for controlling, monitoring and/or servicing a heat-treatment process remotely via wireless communications.

A particular embodiment is illustrated in FIG. 1. For the pre-welding stage of the heat-treatment process, this embodiment provides a unique feature called a Smart Light. Referring now to FIG. 1 the Smart Light 10 is a high-visibility LED indicator fitted with a magnetic mount, which provides the capability to attach the light to the steel pipe in the vicinity of the weld area. The Smart Light 10 assists in the adherence to the appropriate welding codes by providing the welder with real-time temperature status indications at the weld area. In turn, this enables the welder to take appropriate action, as required.

The following four conditions are indicated by the Smart Light 10: (1) no light—power is off to the weld area; (2) slow blinking—temperature is either ramping up to specification or cooling down; (3) solid light—the temperature is within specifications; (4) rapid blinking—alarm condition signalling some type of malfunction of the Super 6Wi as described below.

The Smart Light 10 may be integrated within the power and thermocouple wiring to form a single cable unit and simplify connections and is controlled by the Super 6Wi 20. The Super 6Wi 20 is equipped with an indicator that provides a similar display to that of the Smart Light 10 at the end of the cable unit of the Super 6Wi 20.

Referring now to FIG. 1 the heating element 11 is wrapped around the weld area in accordance with the wrapping specifications. Heating cables 12 are hardwired to the heating element 11 and connected to the Super 6Wi 20. Additionally, high temperature Type K thermocouples 13 are spot-welded to the weld area at pre-determined sites in accordance with the applicable standards and as outlined on the Wrapping Specification Sheet provided. The other ends of the thermocouple leads are connected to the Super 6Wi 20. After installation of the heating element(s) 11 at the weld area, the entire heat-treatment process may be automatically controlled and continuously monitored as disclosed elsewhere herein.

The Super 6Wi 20 is an intelligent and portable heat-treatment unit. The Super 6Wi 20 is unique in that it includes a solid state computer composed of an embedded microprocessor 21 with recording capabilities, and a wireless radio device 22. Power to the Super 6Wi 20 is provided either by an in-plant 600/480V 3-phase power supply or by a diesel generator. The Super 6Wi 20 accepts temperature profiles and alarm parameters and provides a number of unique features. These include a wireless status indicator, Smart Light temperature status indicator, six thermocouple inputs measured at a rate of four times per second, and built-in 100 ft secondary cables. The built-in secondary cables eliminate the mechanical connections between the cables and conventional heat-treatment units, and the failure risks associated with these connections.

The Super 6Wi 20 is programmed using the temperature profiles and alarm parameters required by the specific heat-treatment process. Programming is performed by entering the appropriate data from computers located at the central Quality Management Center (QMC) 60 via a proprietary software package, called Data Manager. The Data Manager contains all the cycle and alarm parameters necessary for achieving a successful heat-treatment process by the Super 6Wi 20.

During the heat-treatment process the thermocouples 13 connected to the weld area continuously provide temperature data to the Super 6Wi 20. The Super 6Wi 20 samples the temperature data from each thermocouple 13 at a rate of four times per second in order to control the electric power to the heating elements 11.

The Super 6Wi's 20 proprietary software also encodes the temperature data generated by the thermocouples and stores it locally in a solid-state, non-volatile memory device. The Super 6Wi 20 is capable of storing this data for up to 6 months. The Super 6Wi 20 encrypts and transmits the encoded data, securely, through the embedded wireless transceiver module 22 over the wireless network 30 to the Site Access Manager (SAM) 40 every five seconds. The wireless network 30 utilizes a spread-spectrum, channel-hopping algorithm that ensures no interference with other wireless networks present on-site. The wireless network 30 uses the 902 to 928 MHz unlicensed bandwidth and is designed to cover an area within a 3-mile range.

In addition to the wireless capability, the Super 6Wi 20 is equipped with a secondary communication port 23. This allows a device to be wire-connected locally in order to perform direct monitoring and control of the Super 6Wi 20, as may be necessary. In the event of a wireless communication failure, the Super 6Wi 20 is equipped with full operational control and it can perform all heat-treatment functions independently of the rest of the system. For safety purposes power supplies are equipped with manual emergency shutdown buttons.

The Super 6Wi 20 has a number of unique alarm features for control and monitoring of the heat-treatment process. These include alarm and hold for over/under temperature condition, open/shorted thermocouple alarm, heater failure alarm, redundant over-temperature shutdown and temperature deviation alarm. These alarm features indicate anomalous conditions that may arise during a heat-treatment process.

The SAM 40 is a portable, solid state embedded computer capable of operating in harsh environments. The computer is mounted in a weatherproof enclosure and is able to operate in temperatures between −20° C. and +60° C. The SAM 40 has minimal power requirements, whereby a 12V battery provides up to 24 hours of continued functioning. Complementary to the Super 6Wi 20, the SAM 40 is equipped with a wireless transceiver module 41. The wireless transceiver module 41 enables the SAM 40 to receive and transmit data to and from all the system's components, the Super 6Wi 20, the QMC 60 and the customer's portable devices 70. The robust wireless connection enables communications up to a distance of three miles without a line-of-sight from the Super 6Wi 20. The SAM 40 is capable of storing heat-treatment data from up to 100 Super 6Wis 20 for up to five days.

The SAM 40 can also function as a communications gateway between the Super 6Wi 20, the QMC 60 and the customer's portable devices 70. The SAM 40 initiates the communication with the Super 6Wi 20 by sequentially polling each Super 6Wi 20 present in the on-site wireless network 30. The SAM 40 gathers temperature data from the Super 6Wi 20 every 30 seconds. The data gathered wirelessly by the SAM 40 is recorded in a solid state memory device every 60 seconds. For redundancy, this data is stored in the SAM 40 for 5 days and is available to be downloaded from the QMC 60.

For reliability purposes the SAM 40 is also equipped with multiple network ports that allow multiple connections to the Internet 50. In addition to the standard Ethernet port 43 the SAM is equipped with a built-in modem 44 for wireless Internet connections using cellular networks, and a standard 802.x wireless device 45. The SAM 40 can be equipped with a local printing option by attaching a printer 46. The SAM 40 also allows for on-site connection of a customer device 70 running the Super View software for local monitoring of the heat-treatment process. This connection is a direct local connection to all Super 6Wi(s) 20 present on site through the SAM 40.

The SAM 40 communicates via a secure Internet connection 50 with the central control and monitoring location, the QMC 60. The QMC 60 is a 24 hours-a-day/7 days-a-week centre operated by fully trained operators. The QMC 60 downloads all of the temperature profiles and alarm parameters to the Super 6Wi 20. The QMC 60 also notifies installation crews of the setup results through various means, including but not limited to cell phones and text messaging. In addition the QMC 60 provides real-time monitoring and control of the heat-treatment process and can send voice and/or text messages containing the status of the heat-treatment process.

The QMC 60 runs the proprietary Data Manager software, which ensures that the entire heat-treatment process adheres to quality control standards. The Data Manager constantly compares temperature data received from the weld area with pre-loaded data for the particular heat-treatment process. Any deviations outside the alarm parameter settings between the two sets of data generate alarms at the QMC 60, and designated personnel are notified. The situation is rectified through the control capabilities of the Data Manager software, which include unit shutdown in the event of over-temperature, alarm/hold protection for over/under temperature, open/shorted thermocouple, and equipment temperature alarm with shutdown protection.

The QMC 60 verifies and archives all of the temperature data from the various Super 6Wi's in stored data banks. In the event that the communication between the SAM 40 and QMC 60 is interrupted, upon re-establishing communications, the QMC 60 is capable of automatically retrieving the missing data from the SAM 40 and synchronizing the data from all devices within seconds. The QMC 60 also attends to complete documentation management, to ensure strict adherence to the Quality Assurance standards of both the SuperheatFGH quality program and the customer's own quality programs.

Figure 3:
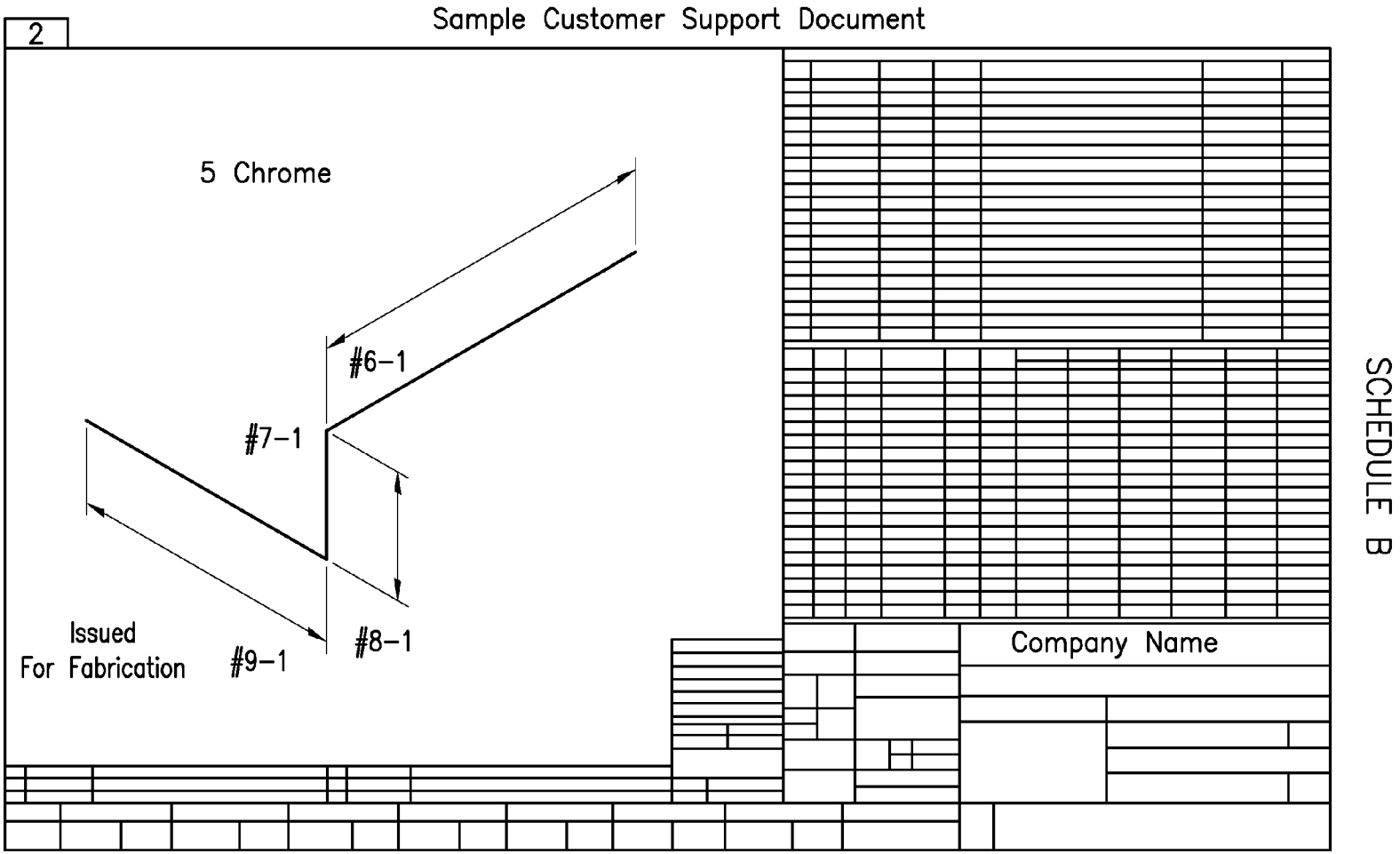
FIG. 3 is an exemplary Customer Support Document containing customer drawings, and used by on-site installation technicians.
Figure 4:
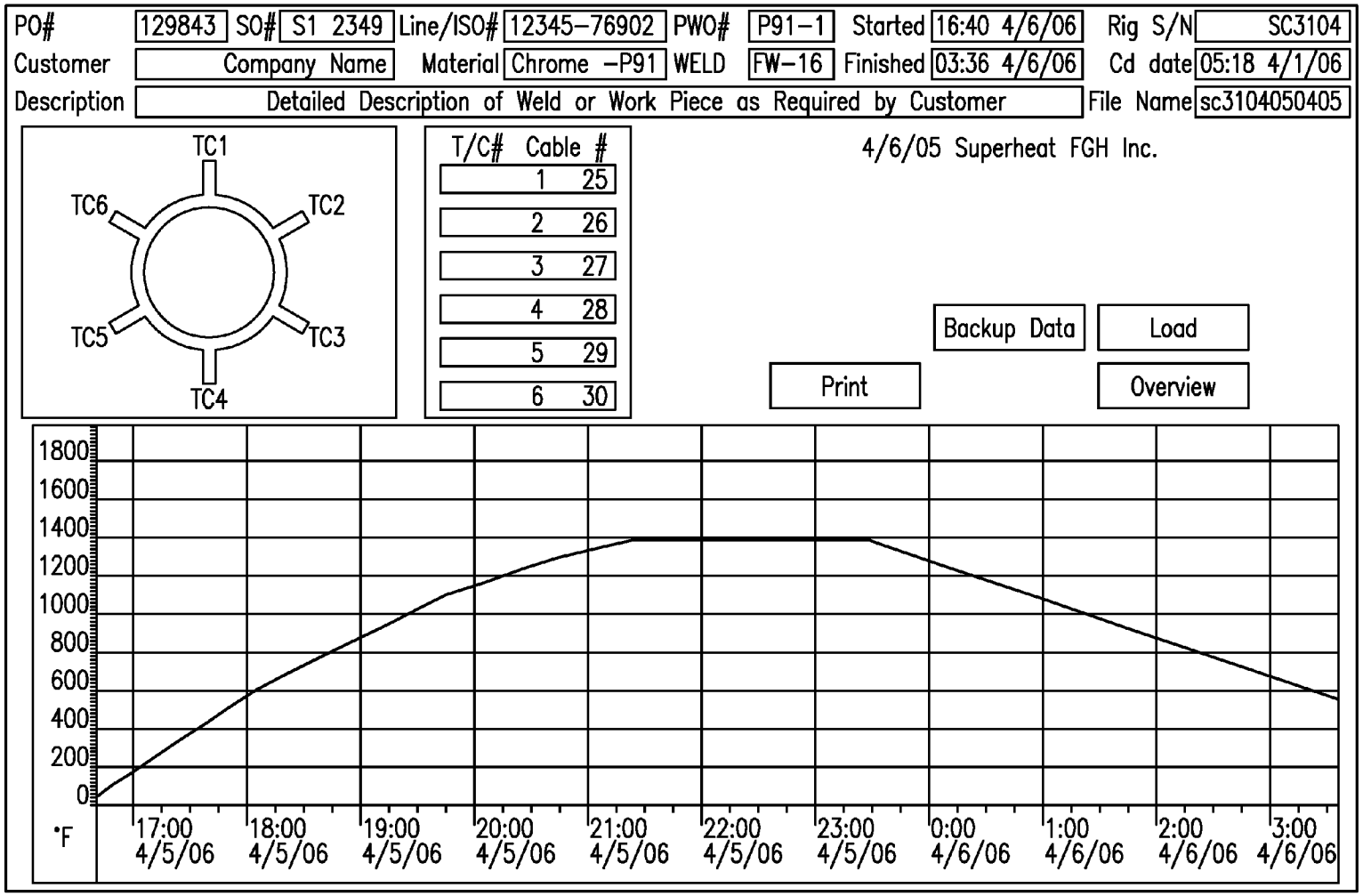
FIG. 4 is an exemplary Secure Data Report created after completion of the heat-treatment process and delivered to the customer, evidencing that the heat-treatment process complies with specifications.

The QMC 60 manages the following documents:

Prework Order Forms—document signed by the customer outlining the specific requirements of the heat-treatment process, a sample of which is attached as Schedule A at FIG. 2;

Customer Support Document—document containing customer drawings, and used by on-site installation technicians, a sample of which is attached as Schedule B at FIG. 3;

Secure Data Report—document created after completion of the heat-treatment process and delivered to the customer, evidencing that the heat-treatment process complies with specifications, a sample of which is attached as Schedule C at FIG. 4;

Brinell Hardness Report—document containing the results of the hardness test, a sample of which is attached as Schedule D at FIG. 5;

Certificate of Calibration—document evidencing the calibration of the Super 6Wi, a sample of which is attached as Schedule E at FIG. 6; and Daily Equipment and Material Work Acceptance Form—document created daily, evidencing the acceptance by the customer of the heat-treatment performed, a sample of which is attached as Schedule F at FIG. 7.

In order to prevent outages the process contains built-in redundancy both in operations as well as communications systems. As previously mentioned, during the heat-treatment cycle, each Super 6Wi 20 is capable of full operational control in case that communications with the SAM 40 and QMC 60 are interrupted. The power supplies are equipped with external, manual emergency shutdown buttons and data is stored in each Super 6Wi 20 for up to six months. The communication systems are protected through the provision of multiple Internet providers and direct telephone connections.

Referring again to FIG. 1, the customer's portable devices 70 may use Super View, which is a proprietary software program that allows users to view real-time temperature data anytime and from any location. The user may connect wirelessly to the SAM 40 or QMC 60 through any popular wireless device, such as a PDA, Tablet PC, laptop or cell phone and retrieve the temperature data that has been gathered, recorded and logged by the SAM 40 and the QMC 60.

In a typical embodiment, the heat-treatment process starts by establishing the on-site secure wireless network 30. The secure wireless network 30 covers 100% of the plant site, so that the signal reaches all areas of the plant. A typical network will have a range of 3 miles in radius and will operate without a line-of-site requirement between the local SAM 40 and the various Super 6Wis 20 present on the plant site.

The next step in the process is the installation of the heating element 11 and the thermocouples 13 at the weld area. If pre-welding heat-treatment is necessary, the installation step will also include the installation of the Smart Light 10 at a suitable position near the weld area, such that the welder has continuous access to it. All of the above components are then connected to the nearby Super 6Wi 20. The entire heat-treatment process is thereby controlled, monitored and documented by the methods and components disclosed here.

Upon completion of the local hardware installation the system is turned on and a connection is established between the QMC 60 and the Super 6Wi 20, through the local SAM 40. The SAM 40 is the link between the multiple Super 6Wi's 20 and the QMC 60 via its various network link capabilities. The SAM 40 acts as a gateway and the Data Manager software running on it has the capability to search for a particular Super 6Wi 20 present in its associated wireless network 30. Once the particular Super 6Wi 20 is found, the QMC 60 programs the Super 6Wi 20 with the particular temperature data and alarm parameters provided by the temperature profile. The heat-treatment process is started by turning on the power to the heating elements. Thereafter the process is continuously monitored and controlled by the QMC 60. However, in the event that communications between the Super 6Wi 20 and the QMC 60 are lost, the Super 6Wi 20 has the capability to independently perform all the functions required by the heat-treatment process.

The thermocouples 13 provide the Super 6Wi 20 continuously with temperature readings from the weld area. The Super 6Wi 20 samples these readings four times per second, and due to the unique recording function present in its embedded microprocessor, it stores the temperature readings locally in non-volatile memory. Upon a request from the SAM 40 the temperature data is encrypted and transmitted securely through the wireless network 30 from each Super 6Wi 20 to the SAM 40. The SAM 40 receives the binary encrypted data from the Super 6Wi 20 and stores it locally, for redundancy purposes, for up to five days.

The SAM 40 is operated by the same Data Manager software package that runs on the QMC 60. This proprietary software is capable of running as both a network server and client for other Data Manager packages. The Data Manager's function on the SAM 40 is that of a server, serving requests from the QMC 60. The Data Manager's function on the QMC 60 is that of a client, requesting information from the SAM 40. Upon receiving the temperature data, the QMC 60 stores it locally and compares it with pre-loaded data. The Data Manager's continuous analysis of the temperature data enables the system to recognize deviations and alarm the technicians at the QMC 60, who will then notify designated personnel to rectify the alarm conditions. This real-time remote monitoring and control capability enables the user to avoid costly failures and re-work in the heat-treatment process.

During the entire heat-treatment process customers may connect to the local SAM 40, either through a local wireless network, or through the Internet 50 and retrieve real-time temperature data from any on-site Super 6Wi 20. This is done with the aid of Super View, a software package that allows viewing of the data in the Super 6Wi 20. Super View enables customers to view both the status of an ongoing heat-treatment process, as well as data previously recorded.

Upon completion of the heat-treatment process the QMC 60 provides the customer with all necessary Quality Control Documents, such as Secure Data Reports, Brinell Hardness Reports and Work Acceptance Forms. The various documents are generated in a digital electronic format, allowing for both e-mailing to customers and printing the electronic files to a standard color printer.

What is claimed is:

1. A system for monitoring and controlling the heat treatment of a plurality of pipe welds simultaneously from a remote location, the system comprising:

a plurality of heating elements positioned about the plurality of pipe welds;

a plurality of thermocouples spot welded about the plurality of pipe welds;

at least one means for operating and controlling the plurality of heating elements, the operating and controlling means continuously receiving heat treatment information during the heat treatment process from the plurality of thermocouples and continuously sending heat treatment instructions to the plurality of heating elements over a local wireless connection, and a means for communication between the operating and controlling means and the remote location, whereby the operating and controlling means send the received heat treatment information and receive heat treatment instructions from the remote location; the communication means providing the communication between the remote location and at least one of the operating and controlling means wherein the communication means is connected with at least some of the plurality of operating and controlling means through a local wireless connection; and a means for observing the communications.

2. The system of claim 1, wherein:

the communicating means is connected with the remote location through a secure Internet connection.

3. The system of claim 1, wherein:

the operating and controlling means further comprises means for storing received heat treatment information and means for storing received heat treatment instructions.

4. The system of claim 3, wherein:

the operating and controlling means further comprises a port for direct downloading of stored heat treatment information and direct uploading of heat treatment instructions.

5. The system of claim 1, wherein:

radio-frequency signals provide the local wireless connection between the heat treatment means and the operating means.

6. A system for remotely managing the heat-treatment of a plurality of remotely-located pipe welds according to a selected protocol, each pipe weld provided with a heat treatment arrangement comprising a heating element, a plurality of thermocouples spot welded about the plurality of pipe welds, a system for operating the heating element and a system for communicating and a the system comprising:

means for receiving heat treatment information from each remotely-located pipe weld over a secure Internet connection;

means for comparing the received heat treatment information from each pipe weld against a set of stored expected values for the selected protocol; and means for sending updated heat treatment instructions to each remotely-located pipe weld over the secure Internet connection.

* * * * *